United States Patent [19]

Doulet

[11] 4,287,971

[45] Sep. 8, 1981

[54] BODY-ATTACHABLE BAG FOR TRANSPORTING ARTICLES

[76] Inventor: Clayton J. Doulet, P.O. Box 220, Dandridge, Tenn. 37725

[21] Appl. No.: 109,154

[22] Filed: Jan. 2, 1980

[51] Int. Cl.[3] ..... A45C 3/10; A45C 13/00; A45C 13/30

[52] U.S. Cl. ..... 190/48; 150/28 A; 224/208; 224/224

[58] Field of Search ..... 190/52, 48; 150/52 J; 224/47, 58, 188, 190, 206, 208, 215, 216, 224

[56] References Cited

U.S. PATENT DOCUMENTS

| | | | |
|---|---|---|---|
| 1,470,334 | 10/1923 | Stensgaard | 224/208 |
| 1,575,875 | 3/1926 | Szeuczyk | 190/52 |
| 2,436,369 | 2/1948 | Allen | 190/48 |
| 2,533,850 | 12/1950 | Syracuse | 190/52 |
| 3,347,429 | 10/1967 | Ruth . | |
| 3,622,056 | 11/1971 | Draeger | 224/47 |
| 3,910,470 | 10/1975 | Swenson | 150/52 J |

*Primary Examiner*—Herbert F. Ross
*Attorney, Agent, or Firm*—Luedeka & Fitch

[57] ABSTRACT

A body attachable bag for suspension from a person's shoulder, constructed of a plurality of panels that individually are substantially non-selfsupporting but which collectively interact with one another to develop and maintain a geometry of the bag that substantially conforms to, i.e. partially wrap the person's torso over a substantial surface area thereby having a reduce tendency to swing when suspended from the shoulder and substantially reducing undesirable pressure points.

4 Claims, 4 Drawing Figures

BODY-ATTACHABLE BAG FOR TRANSPORTING ARTICLES

This invention relates to bags for transporting articles and particularly to a bag adapted to be carried in contact with a person's torso.

Bags adapted to be carried by suspending the bag from a person's shoulder are well known in the art. These include shoulder bags, luggage, gadget bags and the like. Other bags adapted to be anchored to a person's torso are also well known, for example, the well known knapsack. These prior bags, when suspended, tend to swing relative to the person's body during walking movements, unless anchored, thereby becoming most annoying and bothersome. This problem is accentuated when the bag carries a relatively heavy object that imparts a blow to the wearer as the bag swings.

In the prior suspended bags and the prior anchored bags, the bags commonly are substantially rigid so as to be self-supporting. In this manner they maintain their desired shape and retain their original pleasing aesthetic appearance. Such rigidity, however, presents problems in that these rigid bags have limited areas of physical contact with the person's body thereby developing pressure points that create discomfort, particularly when transporting heavy articles. The rigidity of these bags further increases the discomfort when a suspended bag strikes the wearer. In certain back packs, it has been proposed to provide a rigid frame which is contoured to fit a person's back. These frames provide support for a limp bag and, of course, are unsuitable for over-the-shoulder suspension use.

The present inventor has discovered a bag construction that is suitable either for over-the-shoulder suspension or for being anchored to a person's torso. The bag is constructed of a plurality of panels that individually are nonself-supporting but which collectively interact with one another to develop and maintain a geometry of the bag that substantially conforms to, i.e. partially wraps, the person's torso over a substantial surface area thereby having a reduced tendency to swing when suspended from the shoulder and substantially reducing the undesirable pressure points. In general, the new bag comprises first and second panels that define the top, and portions of the ends, of the bag, plus a top opening, and further panels that define the opposite sides and bottom of the bag. In one embodiment, separate additional panels complete the ends of the bag. In the bag, each of the first and second panels is elongated and has one nonstraight, outboard, side edge (when flat). The nonstraight, and outboard, side edge of the first panel is concave in that portion thereof which is disposed on the top of the bag, whereas, the nonstraight outboard side edge of the second panel is convex in that portion thereof which is disposed on the top of the bag. The opposite, i.e. inboard, side edges of the first and second panels are contiguous to one another and define a top opening to the bag. Closure means, such as a zipper, is provided along these contiguous side edges of the first and second panels. The bottom panel is provided with like concave and convex outboard side edges so that when the side panels are joined about their perimeters to the outboard side edges of the top and bottom panels, the side panels are forced to assume respective concave and convex geometries. Each of the panels is individually flexible and nonself-supporting. However, as found by the present inventor, by joining the panels one to another as described herein, the bag as a whole assumes a geometry that conforms, on one side, to the contour of a person's torso so that the bag tends to hug the torso and resist swinging. Further, there is developed a relatively large area of physical contact of the bag with the torso thereby reducing the development of pressure points, even when the bag carries heavy articles, such as roller skates for example. Straps are provided for shoulder suspension of the bag or alternatively for otherwise anchoring the bag to a person. In one embodiment, the bag may be both suspended and anchored simultaneously.

It is therefore an object of this invention to provide an improved bag for securement to a person's torso, such bag having reduced tendency to shift relative to the torso and having a reduced tendency to develop pressure points. Other objects and advantages will be apparent from the following description including the claims and the drawings in which:

Figure 1:
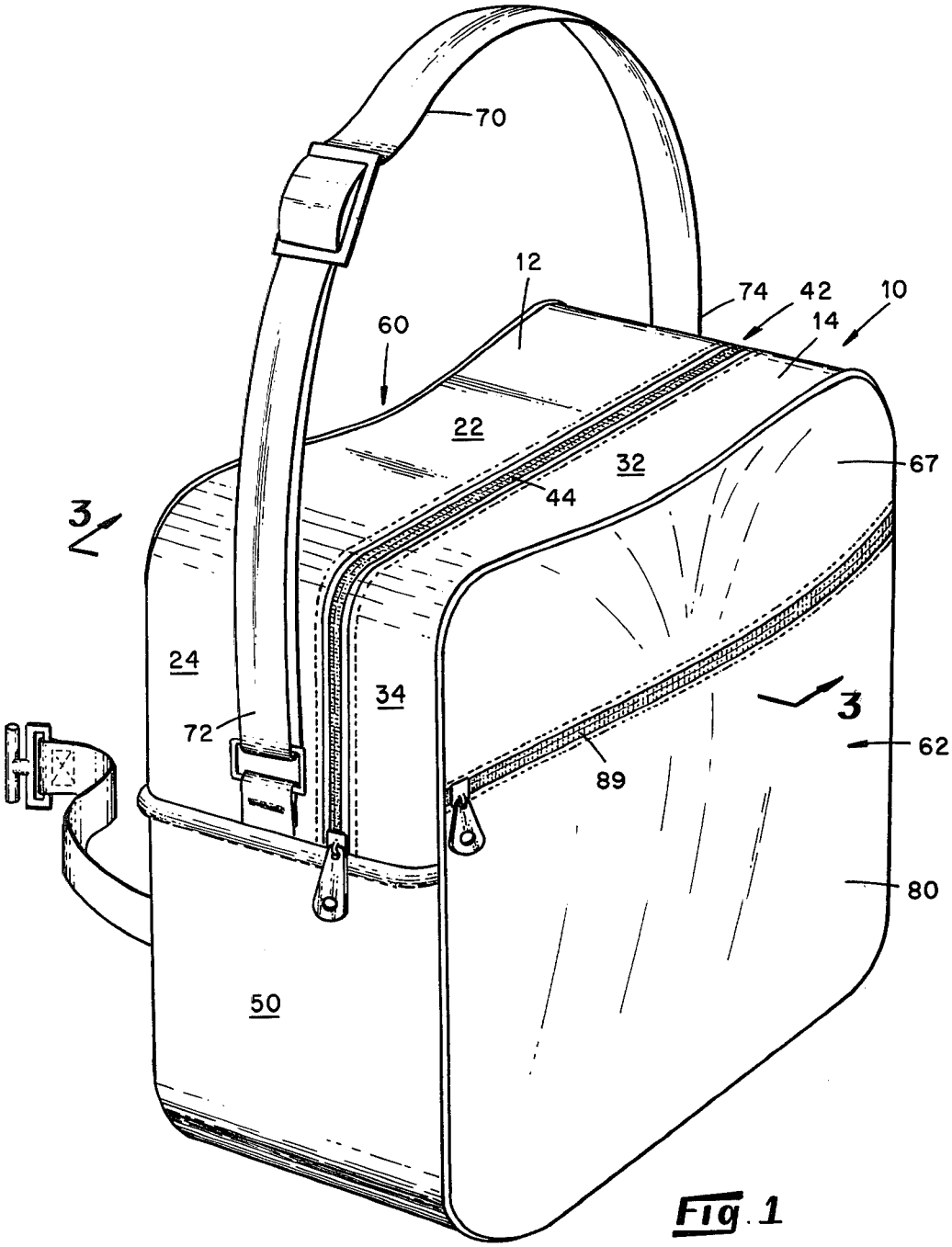
FIG. 1 is a perspective view of a bag embodying various features of the invention.
Figure 2:
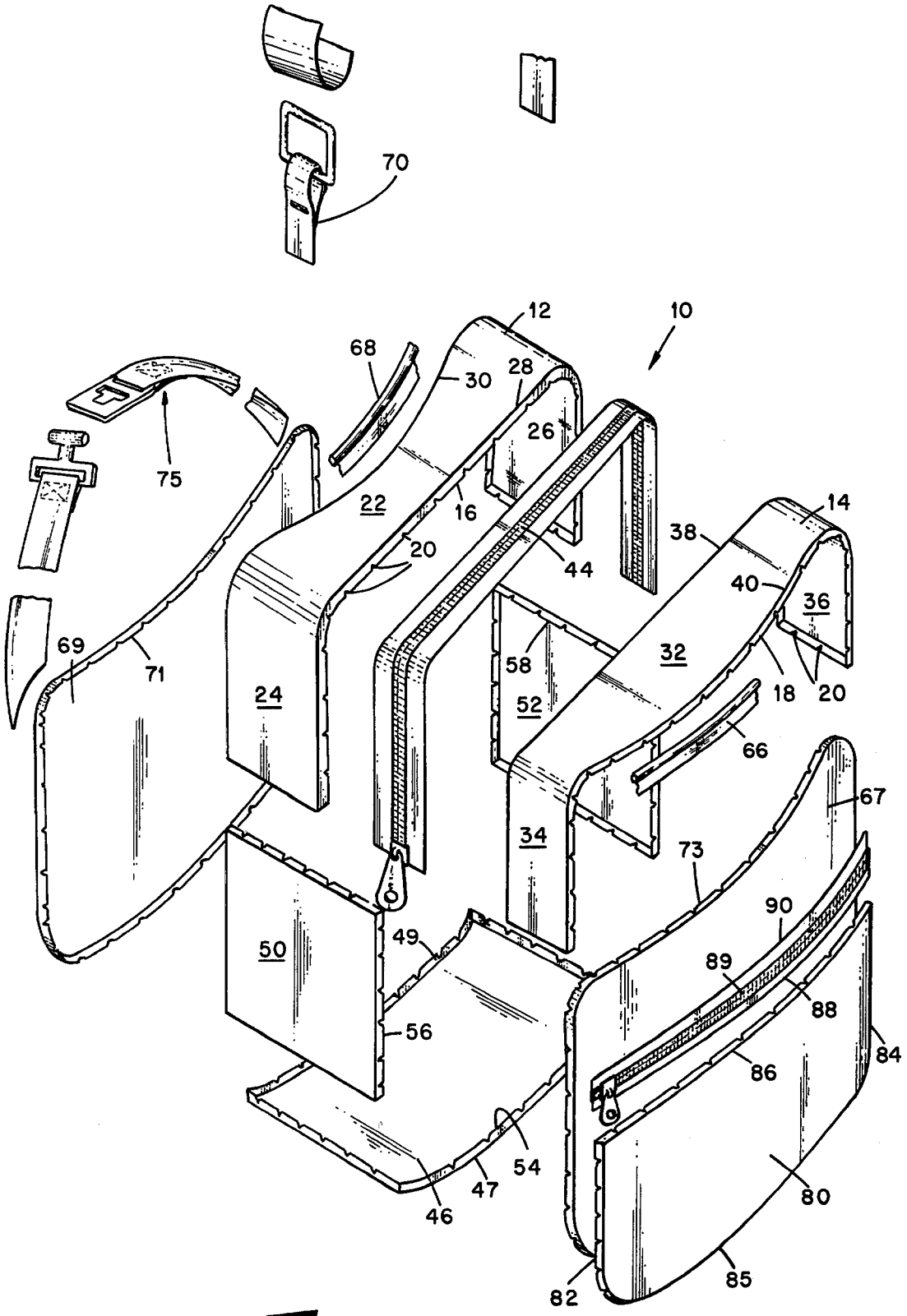
FIG. 2 is an exploded view of the bag depicted in FIG. 1; and, FIG. 3 is a cross-sectional view taken along line 3—3 of FIG. 1.
Figure 3:
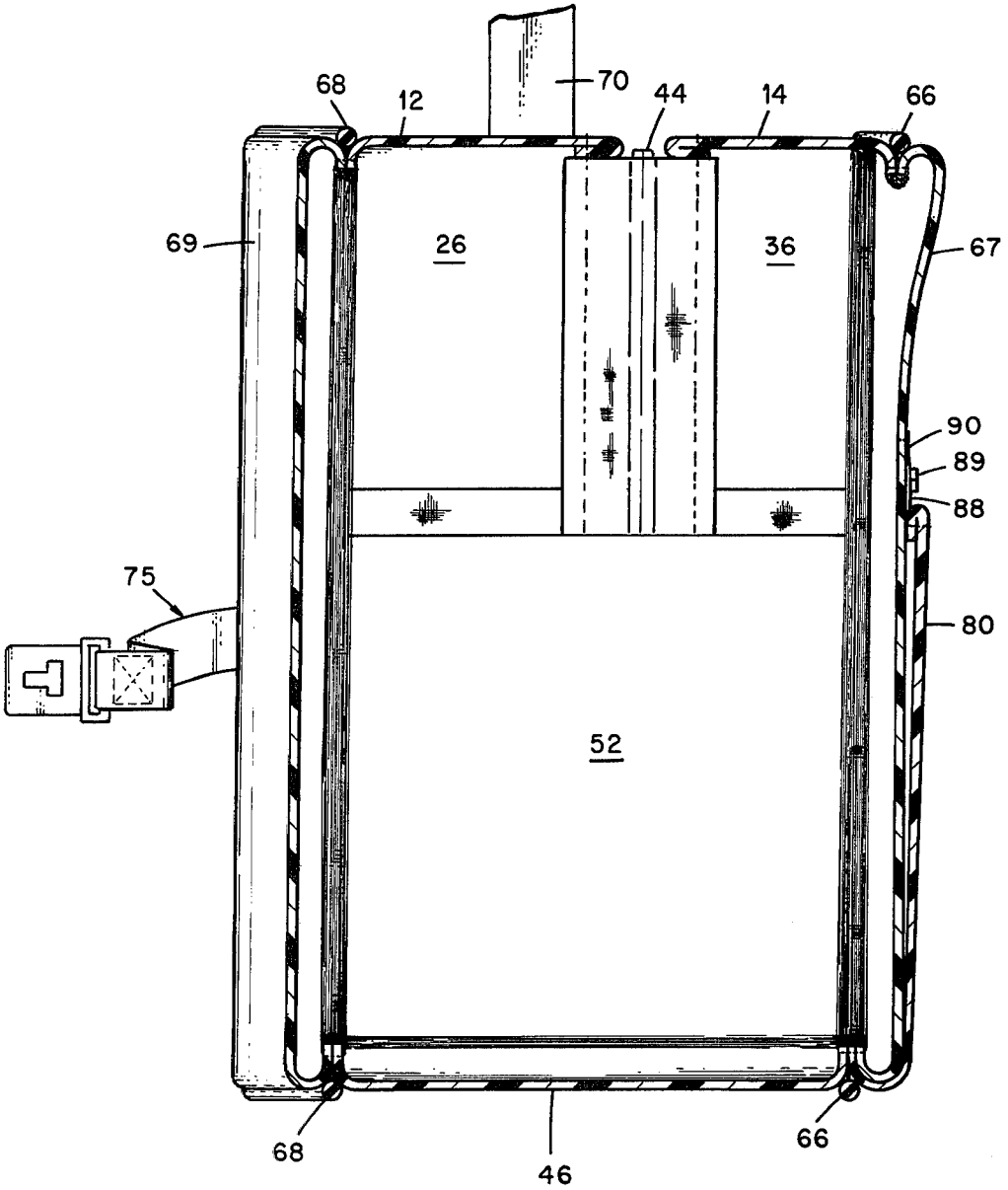
Figure 4:
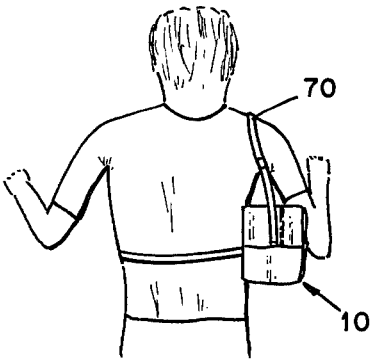
FIG. 4 depicts a bag as disclosed herein in a position of use in contact with a person's torso.

With reference to FIG. 1, one embodiment of the depicted bag 10 comprises first and second panel members 12 and 14, respectively, each of which is provided with an inturned perimetral edge 16 and 18, having triangular notches 20 cut therein to facilitate bending or shaping for assembly and binding. As seen in FIG. 2, the first panel 12 comprises a central portion 22 that defines one side of the top of the bag and opposite end portions 24 and 26 that are bent downwardly from the top of the bag in a U-shape to define a substantial part of each of the opposite ends of the bag. This depicted panel 12, when laid out flat, includes a straight side edge 28 and an opposite non-parallel, i.e., nonstraight, outboard side edge 30. The side edge 30, in the central portion thereof is curved inwardly of the panel to define a concave side edge in such central portion.

The second panel 14 similarly includes a central portion 32 that defines the opposite side of the top of the bag and opposite end portions 34 and 36 that are bent downwardly from the top of the bag in a U-shape to define a further substantial part of the opposite ends of the bag. This panel 14, is essentially equal in length to the first panel 12 and is coterminal therewith in the completed bag, but is more narrow in width than the first panel, and, when laid out flat, includes a straight side edge 38 and an opposite non-parallel, i.e., nonstraight, outboard side edge 40. The side edge 40, in the central portion thereof, is curved outwardly of the panel to define a convex side edge in the central portion of the panel. as depicted, the straight side edges 28 and 38 are disposed in contiguous side-by-side alignment to define a top opening of the bag, indicated by the numeral 42 and which extends across the full width of the bag and further down along each of the opposite ends of the bag by a substantial distance. Because of the uneven widths of the first and second panels, the top opening is "off-center" toward the front of the top of the bag, thereby permitting the attachment of strap means approximately centrally of each of the opposite ends of the bag. Closure means such as a zipper 44 is joined along its opposite side edges to and between the contiguous side edges 28 and 38 to provide for selective opening and closing of the bag. Notably, in a preferred embodiment, the zipper extends downwardly from the top of the bag along each of the opposite ends of the bag by a substantial distance. By this means, when the zipper is fully opened, the second (front) top panel is foldable down and outwardly of the bag to provide an opening for access to the bag, such opening having a major dimension that is greater than the width dimension of the bag. It is to be understood that the inboard contiguous side edges 28 and 38 of the first and second top panels need not be straight but can assume other configurations, such as an arcuate configuration. It is important, however, that these side edges be substantially contiguous to one another so as to provide for closing the top of the bag.

Referring to FIG. 2, the bag 10 further includes a bottom panel 46 which defines the bottom of the bag. This depicted bottom panel 46 is provided with substantially parallel, but nonstraight opposite side edges 47 and 49. The back side edge 49 curves inwardly of the panel 46 to define a concave edge that is of substantially the same geometry as the outboard side edge 30 of the first top panel 12 and is disposed on the same side of the bag as is the side edge 30. The opposite side edge 47 (front side edge) of the bottom panel is of a convex geometry that is substantially identical to the convex geometry of the outboard side edge 40 of the second top panel 14.

In the bag depicted in FIGS. 1 and 2, planar end panels 50 and 52 are provided for closing the opposite ends of the bag in the region between the bottom panel 46 and the downwardly bent end portions 24, 26 and 34, 36 of the first and second top panels 12 and 14. Each such end panel 50 and 52 is provided with an inturned, notched perimetral edge 56 and 58, respectively, which facilitates assembly of the bag.

The front and back sides of the bag are closed as by planar panels 67 and 69, each of which is provided with an inturned, notched perimetral edge 71 and 73. This perimetral edge is suitable for joining a side panel to the adjacent perimetral edges of the top, bottom and end panels. It is to be noted that the side panels 67 and 69 are depicted in FIG. 2 as having a curvilinear geometry only for purposes of illustration. Before assembly, these panels, as well as each of the other panels in the bag, are planar, i.e., laid out flat. Only after assembly do the side panels adopt their respective concave and convex geometries.

Strap means 70, preferably of adjustable length, is secured at its opposite ends 72 and 74 to the opposite ends of the bag to extend upwardly from the bag and provide the means for supporting the bag from a person's shoulder. Further strap means 75 is secured to the rear side edge of the bag to extend therefrom and encircle a person's torso and be anchored to the opposite rear side edge of the bag for anchoring the bag to the torso.

In the embodiment of the present bag shown in FIGS. 1 and 2, each of the panels is of an identical material, specifically 15 gauge cotton canvas to which there has been laminated a layer of 7 gauge vinyl plastic. One such suitable material is available from Jersey Backing of Secaucus, New Jersey. This material is flexible and nonself-supporting. It, however, is substantially nonstretchable and noncompressible in the planar dimension thereof. Accordingly, when assembled as described hereinafter, the bag is caused to assume the geometry depicted in FIG. 1, that is, the back 60 of the bag is caused to assume a concave geometry and the front 62 of the bag is caused to assume a convex geometry. In one embodiment, the desired wrapping engagement with a user's torso is obtained when the concave geometry of the rear side of the bag has a radius of curvature about $7\frac{1}{2}$ inches.

In assembling the bag depicted in FIGS. 1 and 2, the individual panels are joined one to another in the relationship shown in FIG. 2, along their respective perimetral edges, as by stitching. In the depicted embodiment, welt means 66 and 68 is included in each of the seams which join the side panels 67 and 69 to respective ones of the first and second top panels and to the respective sides of the bottom panel 46, as well as to the side edges of the end panels 50 and 52. It is to be noted that the joining of the several elements of the present bag must be accomplished while the bag is turned inside out so as to expose the contiguous perimetral edges of the various elements for stitching purposes. Following its assembly, of course, the bag is turned so that the stitched edges are disposed internally of the bag to thereby provide an attractive joinder along each of the contiguous edges of the several elements on the exterior of the bag. In an alternative embodiment of the bag depicted in FIGS. 1 and 2, there is provided a further side panel 80 which is of substantially the same width as side panel 67 but approximately two-thirds of the height of such side panel 67. This smaller side panel 80 is incorporated into the bag by stitching its opposite side edges 82 and 84 and its bottom edge 85 simultaneously with the stitching of the side panel 67 to its respective abutting elements. The top edge 86 of the side panel 80 is joined, as by stitching, to one side edge 88 of the zipper 44. The opposite side edge 90 of the zipper 44 is attached to the face of the side panel 67. When these panels are incorporated into the bag, the exposed outer surface of the side panel 67 and the smaller side panel 80 define a pocket means along the front side of the bag 10. In the finished bag, the vinyl coating is disposed inwardly of the bag to resist abrasion, tears, etc. The vinyl further provides waterproofing of the bag.

In and of itself, each of the several panels of the present bag provides relatively small resistance to distortion out of its planar geometry, but when sewn into the present bag, each panel interacts with the remaining panels to develop an unexpected tendency of the bag to retain the geometry which is developed when the several panels are joined as described and shown in the Figures. This synergestic effect has been found to provide a bag that retains the desired geometry which provides conformity to a person's torso while providing the desired support for the contents of the bag.

While a preferred embodiment has been shown and described herein, it will be understood that there is no intent to limit the invention by such disclosure, but rather, it is intended to cover all modifications and alternate constructions falling within the spirit and scope of the invention as defined in the appended claims.

What is claimed is:

1. A bag particularly suitable for transporting an article in a suspended position alongside of and in substantial wrapping contact with the user's body and having a reduced tendency to swing relative to such user's body during the user's walking or other movements, said bag comprising strap means of suitable length to overwrap the shoulder of a user and having its opposite ends extending downwardly from such shoulder in the direction of a user's waist, first flexible elongated panel means formed into a generally inverted U-shape with its base portion defining a substantial portion of the top of said bag and its leg portions defining substantial portions of the opposite ends of said bag, said ends of said strap being secured to respective ones of said leg portions, second elongated panel means of substantially the same length as and substantially coterminal with said first panel means but of more narrow width disposed in side-by-side relation to said first panel means with one of the side edges of said first panel means being contiguous to one of the side edges of said second panel means, said contiguous side edges being aligned along the aforesaid U-shape to define a top opening in said bag, closure means extending along said contiguous side edges and adapted to releasably join said side edges to one another, third elongated flexible panel means defining the bottom of said bag, fourth and fifth planar panel means interposed between said bottom panel and the coterminal ends of said first and second panel means, means joining each of said fourth and fifth panel means to said respective coterminal ends of said first and second panel means and said bottom panel means, first side panel means, means joining said first side panel means along its perimeter to the outboard side edges of said first, third, fourth and fifth panel means to close one side of said bag, second side panel means, means joining said second side panel means along its perimeter to the opposite side edges of second, third, fourth and fifth panel means to close the opposite side of said bag, said first panel means having one side edge which is outboard and concave with respect to the length dimension of said first panel along that portion thereof which is disposed on the top of said bag, said third panel means having one side edge which is outboard of said bag and concave with respect to the length dimension of said third panel in that portion thereof which is disposed on the bottom of said bag whereby said first side panel, when joined to said side edges as aforesaid, is caused to assume a concave geometry.

2. The bag of claim 1 wherein said second panel means includes one side edge that is outboard of said bag and convex with respect to the length dimension of said second panel means, and said third panel means includes one side edge that is outboard of said bag and convex with respect to the length dimension of said third panel means, said convex edges being in register but spaced apart from one another.

3. The bag of claim 1 wherein said concave geometry has a radius of curvature of about seven and one-half inches.

4. The bag of claim 1 wherein each of said panels comprises cotton canvas laminated to about seven gauge vinyl plastic.

* * * * *